US005802989A

United States Patent [19]

Veyhl

[11] Patent Number: 5,802,989

[45] Date of Patent: Sep. 8, 1998

[54] TABLE SUPPORT STRUCTURE

[75] Inventor: Wolf Veyhl, Neuweiler, Germany

[73] Assignee: Veyhl GmbH, Neuweiler, Germany

[21] Appl. No.: 942,324

[22] Filed: Oct. 1, 1997

[30] Foreign Application Priority Data

Oct. 14, 1996 [DE] Germany ..... 196 42 387.2

[51] Int. Cl.[6] ..... A47B 3/06

[52] U.S. Cl. ..... 108/153.1; 108/144.11; 108/106; 108/92

[58] Field of Search ..... 108/180, 144.11, 108/95, 96, 92, 91, 106, 183, 147.15, 147.3, 50.11, 108, 153.1; 248/161, 759, 415, 157, 188.1

[56] References Cited

U.S. PATENT DOCUMENTS

| | | | |
|---|---|---|---|
| 275,027 | 4/1883 | Drake | 108/106 |
| 2,161,578 | 6/1939 | Johnson | 108/106 |
| 3,182,613 | 5/1965 | Hagan | 108/92 X |
| 3,848,844 | 11/1974 | Barrett | 108/106 X |
| 4,010,698 | 3/1977 | Taub | 108/183 |
| 4,779,540 | 10/1988 | Dion et al. | 108/95 X |

FOREIGN PATENT DOCUMENTS

0500187A1 2/1992 European Pat. Off. .

*Primary Examiner*—Jose V. Chen
*Attorney, Agent, or Firm*—Paul Vincent

[57] ABSTRACT

A table support structure comprises a column (11) and a foot (12). A bar (13) is disposed within the column (11) and can be rotated in the column (11) in the direction of arrow (14) and displaced in the column (11) in the direction of arrow (15). The column (11) has plates (19, 20, 21, 22) which are held together by support rods (24). A plurality of bars (13) can be simultaneously disposed in column (11) to hold a support (18) via an adapter (16). Various objects can be attached to the adapter (16) such as additional supports, plates, extension arms and the like.

11 Claims, 4 Drawing Sheets

TABLE SUPPORT STRUCTURE

This application claims Paris Convention priority of German patent application 196 42 387.2 filed Oct. 14, 1996 the complete disclosure of which is hereby incorporated by reference.

BACKGROUND OF THE INVENTION

The invention concerns a table support structure comprising a column, a foot which can be firmly connected to the column and a bar vertically disposed in the column which can be rotated about a vertical axis and displaced along this axis, wherein an adapter is disposed on the free end of the bar projecting beyond the column, the adapter being connected for mutual rotation with the bar, the adapter having a receptacle for a first free end of a support which can be attached to the adapter.

This type of table support structure is e. g. known in the art of tables having a central table support with this table support being e. g. adjustable in height and rotatable about its table support axis.

The purpose of the invention is to further improve a table support of the above mentioned kind in such a fashion that the table support can assume additional functions, e. g. can accept a plurality of table plates in differing planes with nevertheless being of simple construction and light weight.

SUMMARY OF THE INVENTION

This purpose is achieved in accordance with the invention in that the column is constructed from mutually spaced plates arranged above another, each plate having a plurality of at least two mutually aligned through holes for accepting the bar, the plates being held together in the vertical direction via support rods.

The table support structure in accordance with the invention thereby has the substantial advantage that at least two bars can be simultaneously inserted into one column and can be connected to differing supports for supporting differing table plates of various sizes and shapes in differing planes. Supports can connect at least two additional table support structures to the first table support structure and supports can connect two additional table support structures to each of the second and third table support structures.

If, in accordance with a preferred embodiment, four through holes are provided for in each plate, then each column having plates of this type can accept four bars, each of which can be connected via supports to additional table support structures.

In the object in accordance with the invention, the column is formed from separated plates which can be securely attached to each other via a plurality of preferentially four support rods. The through holes in the individual plates are aligned with each other so that rods can be inserted into the column along the entire column height.

This has the advantage that the bar can be supported by the plates when a force is exercised on the bar.

Each bar ends in an adapter which forms a connecting piece to a support or directly to the table plate. A bar can be introduced into each plate of the column for connection to a support. Individual bars can be rotated and their height adjusted in the column so that, with a plurality of table support structures, a table plate pattern having the most differing of contours can be created. The table support structure in accordance with the invention is preferentially suitable for connection to plates of arbitrary shape and table plates can be attached at differing heights above the floor in a permanent and secure fashion. Printers, monitor screens and typewriters, which must often be arranged at the most differing of heights, can be borne using the table support structure in accordance with the invention at receiving surfaces introduced onto the table support structure in a manner which accommodates available space. Elevated desk structures can likewise be effected without requiring special construction.

The plate-support rod construction not only effects a table support structure in accordance with the invention which is light weight, but one which can also be strongly loaded and which is stiff under torque. In a preferred embodiment, the bars inserted in the column accommodate four different applications on one column in a very spatially compact fashion.

In a preferred embodiment of the invention, the through holes have a separation from the support rods or from the support rod attachment on the plate which is larger than the largest outer dimension of the adapter. This has the advantage that a plurality of bars disposed in a column can each be pivoted through a large angle in the column without having them interfere with adjacent support devices. The wide range of applications for the table support structure in accordance with the invention is thereby substantially improved.

In an additional embodiment of the invention, the plates have at least one separation with respect to each other in a vertical direction which is larger than the maximum height of the adapter.

This has the advantage that more than one bar can be easily pivoted between two plates, and the height of the bars can also be adjusted in the column despite the fact that the neighbouring plate forms a stop for the adapter disposed on the bar. This configuration facilitates additional applications.

In a further embodiment of the invention, the plates are provided with grooves on their outer periphery.

This has the advantage that additional covers can be clipped onto the column in a simple fashion. In this manner, the technical components of the column can be aesthetically covered and the most differing of column shapes can be created in a simple fashion which nevertheless function in the same manner.

In a preferred embodiment of the invention, the adapter has a bolt which can be rotated within the receptacle and which functions as an eccentric member. This has the advantage that supports inserted into the adapter can be connected in a continuously displaceable fashion to the bar to which the adapter is attached. This facilitates easy adjustment of the support and a plurality of table support structures, each of which is likewise connected via an adapter to the other free end of a support, can be securely erected at differing separations from another.

In a particular embodiment, the support comprises a plurality of dovetail-shaped protrusions distributed about the outer periphery. This has the advantage that extension arms can also be disposed on the support, same being held in a secure fashion and attached to the support. The table plates are attached to the extension arms. The dovetail-like protrusions also function as stiffeners so that this type of support is capable of permanently supporting large weights.

In a further embodiment of the invention, ringed grooves are provided around the outer periphery of the bar at axial separations from another. This has the advantage that the height of a bar can be fixed in a simple fashion using these ringed grooves. Towards this end, in an improvement of the invention, one or a plurality of pivotable catches are disposed on the outer surface of the plate to project into the through holes in a pivoted position at least to a small radial extent. In the event that a catch is pivoted into the through hole region, it can only engage into the through hole when the bar is inserted if it seats on a ringed groove allowing pivoting into the through hole. When the catch engages the ringed groove, the height of the bar is secured. In the event that the height of a bar or of a table plate attached thereto is to be changed, the catch is pivoted out of the engagement region of the through hole and the bar can be axially displaced. The closer the ringed grooves are spaced relative to each other, the finer is the height adjustment of a bar.

Most differing table plates can either be attached to extension arms held on a support or table plate systems are directly attached to supports connected between two table support structures.

In this fashion the table support structure in accordance with the invention satisfies all extensive demands for construction of the most differing of office landscapes. With a plurality of identically configured table support structures, large conference tables can be constructed having the most differing of shapes. The most differing of shapes for the feet do not influence the function of the table support structure in accordance with the invention.

Further advantages can be derived from the description and the accompanying drawing. The above mentioned features and those to be described further below can be utilized in accordance with the invention individually or collectively in arbitrary combination. The embodiments mentioned are not to be considered as an exhaustive enumeration, rather have exemplary character only.

The invention is shown in the drawing.

DESCRIPTION OF THE PREFERRED EMBODIMENT

In the figures, the same object is designated with the same reference symbol.

Figure 1:
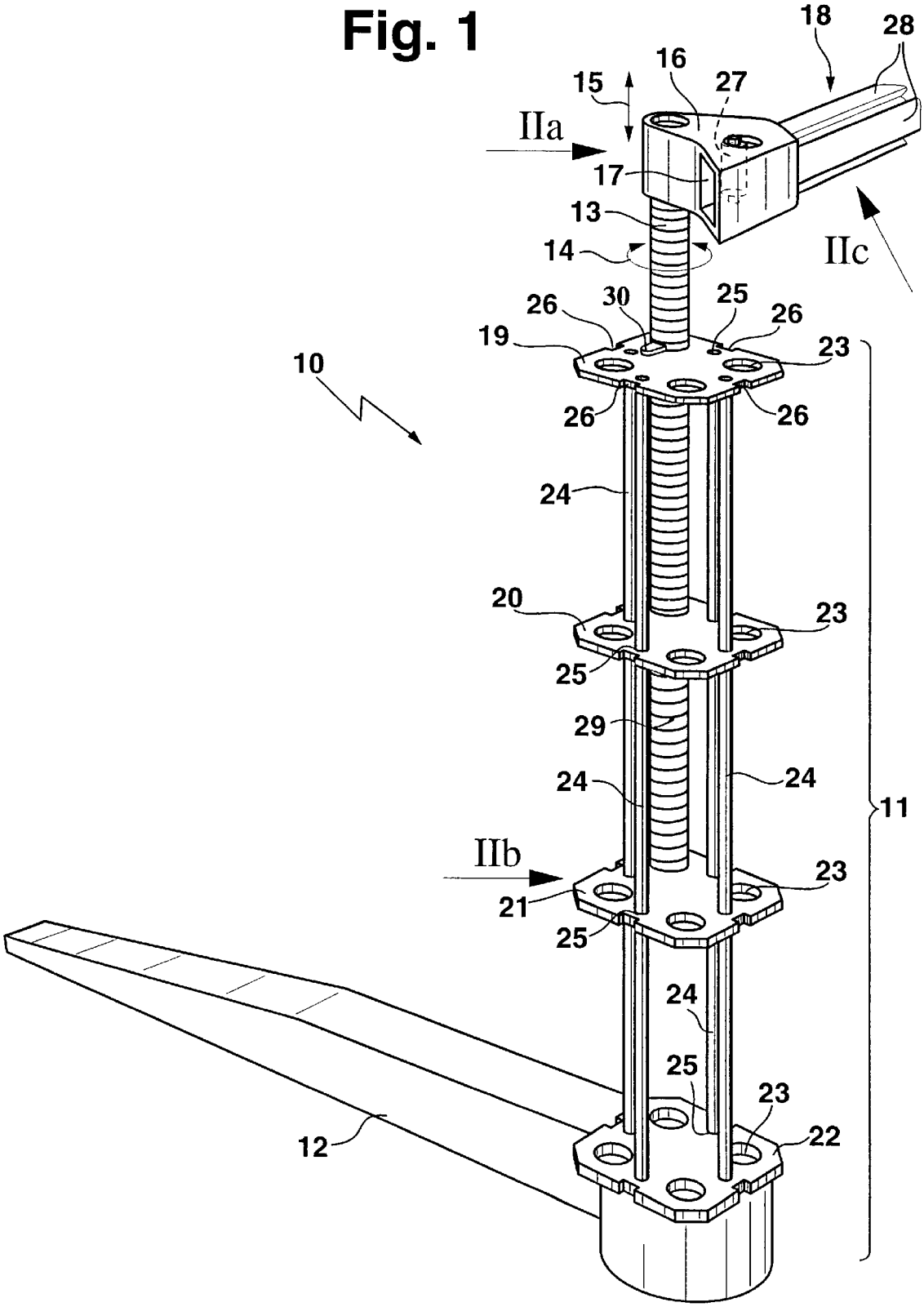
FIG. 1 shows a table support structure in accordance with the invention having a partially shown support engaging an adapter.

FIG. 1 shows a table support structure 10 comprising a column 11 and a foot 12. A bar 13 is inserted into the column 11 and can be rotated in the direction of arrow 14 and displaced in the column 11 in the direction of arrow 15.

An adapter 16 is attached to the end of the bar 13 above the column 11 having a receptacle 17 for a support 18. Only a small portion of the support 18 is shown.

The column 11 is comprised of plates 19, 20, 21, 22, wherein the plates 19, 20, 21, 22 have through holes 23. In FIG. 1, each plate 19, 20, 21, 22 has four through holes 23. The plates 19, 20, 21, 22 are securely attached to each other via support rods 24. The support rods 24 penetrate through the individual plates 19, 20, 21, 22 or they are welded or screwed into each of the plates. The weldments or threaded joints constitute support rod attachments 25.

Grooves 26 are provided in the plates 19, 20, 21, 22 at the outer periphery and constitute support locations for covers to hide the technical components of the column 11.

A bolt 27 is borne in the adapter 16 in an eccentric rotatable fashion. When rotated, the bolt 27 projects into the receptacle 17 of the adapter 16. When the bolt 27 is appropriately rotated, it can clamp and secure the position of a support 18 introduced into the receptacle 17. Another rotated position of the bolt 27 disengages the support 18.

The support 18 has dovetail-shaped protrusions 28, and additional elements can be positioned over the protrusions 28 and securely attached to the support 18.

The bar 13 is provided with ringed grooves 29 along its length. A catch 30 is attached in a pivotable fashion to the surface of the plate 19 and engages into these ringed grooves 29. A catch 30 can be associated with each through hole 23. When pivoted, the catch 30 engages into the ringed grooves 29 of the bar 13 to thereby hold the bar 13 at a particular position.

Figure 2A:
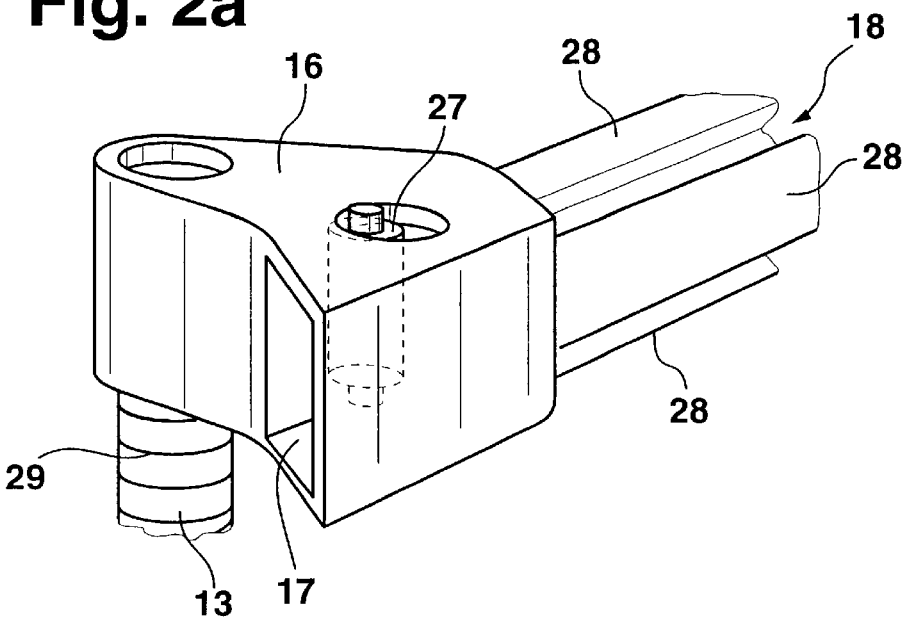
FIG. 2*a* shows an individual detail IIa of FIG. 1.

FIG. 2*a* shows an enlarged representation of section IIa of FIG. 1. The bar 13 is schematically indicated only and the ringed grooves 29 fashioned in the outer surface of the bar 13, e. g. stamped therein, can be easily seen. The adapter 16 is attached in such a manner that it does not rotate relative to the bar 13 and a support 18 is partially inserted into the receptacle 17. The free end of the support 18 is inserted far enough into the receptacle 17 that the bolt 27 can clamp and hold the free end of the support 18 in the receptacle 17 when appropriately rotated. Dovetail-like protrusions 28 are shown on the support 18 onto which correspondingly shaped extension arms or other elements can be disposed. These dovetail-shaped protrusions 28 facilitate the attachment of elements in a secure and guided fashion to which additional loads such as table plates and the like can be attached.

Figure 2B:
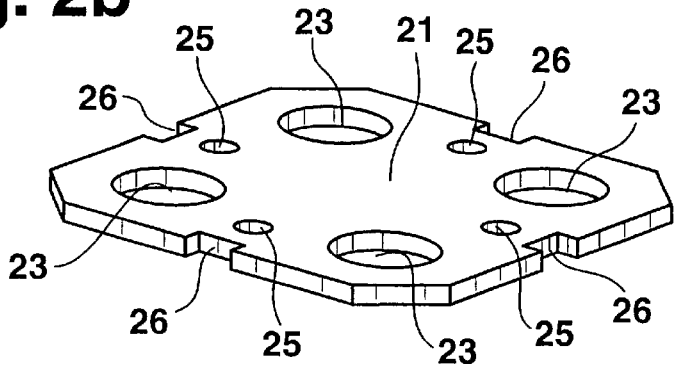
FIG. 2*b* shows an individual detail of a plate in accordance with IIb of FIG. 1.

FIG. 2*b* shows an enlarged representation of the plate 21 in accordance with IIb of FIG. 1. The plate 21 has four through holes 23 and the support rod attachments 25 are indicated with circles. Square grooves 26 are formed in the outer periphery of the plate 21 and function as receiving grooves for covers held on the column 11.

Figure 2C:
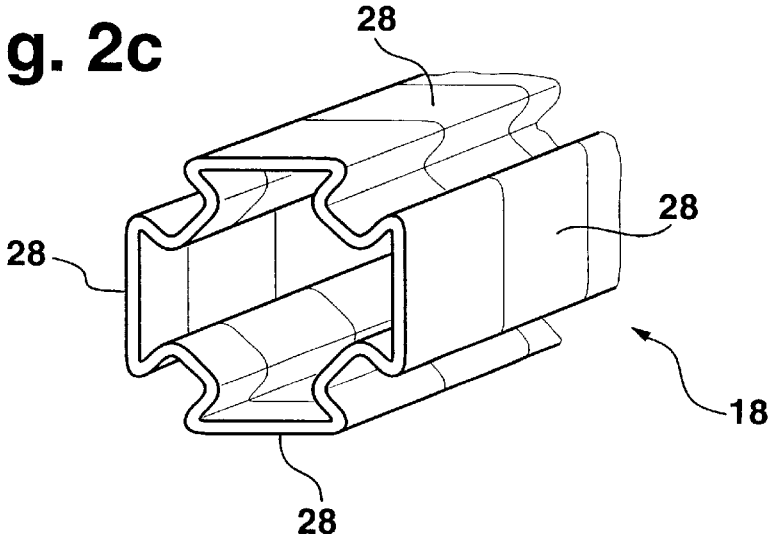
FIG. 2*c* shows an enlarged representation of a support section in accordance with IIc of FIG. 1.

FIG. 2*c* shows an enlarged representation of a section of the support 18 which is e. g. guided in the adapter 16 in FIG. 1. Dovetail-shaped protrusions 28 are clearly formed on the hollow support 18.

Figure 3:
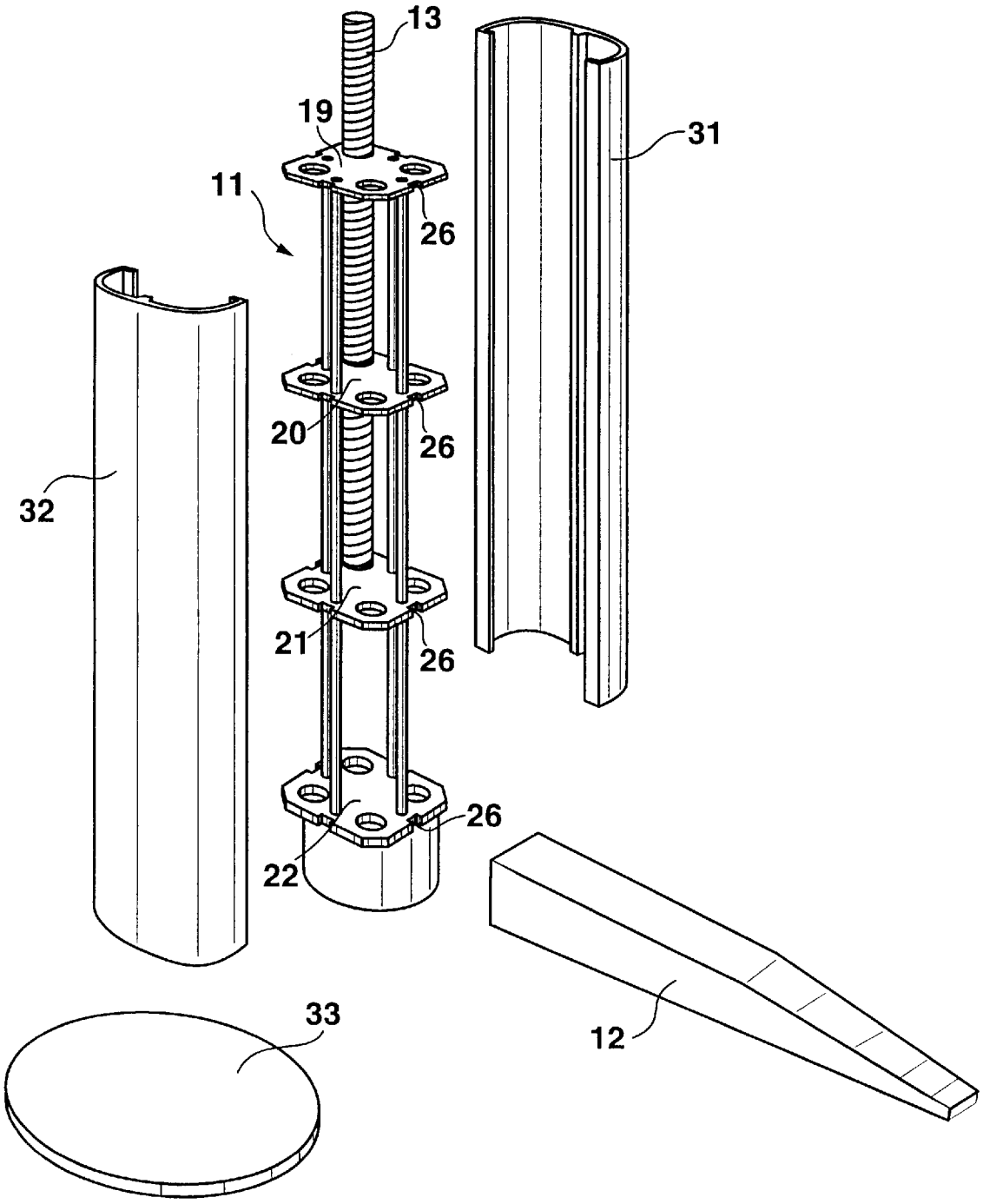
FIG. 3 shows a table support structure in accordance with the invention having an exemplary cover means and two differing foot shapes.

FIG. 3 shows the column 11 having plates 19, 20, 21, 22 which can accept a bar 13 without adapter. Grooves 26 are indicated on the outer contours of the plates 19, 20, 21, 22 into which the covers 31, 32 can be clipped. In addition to a bar-shaped foot 12, a plate 33 is also shown which can replace the foot 12. The foot 12 or the plate 33 are firmly attached to one end of the column 11.

Figure 4:
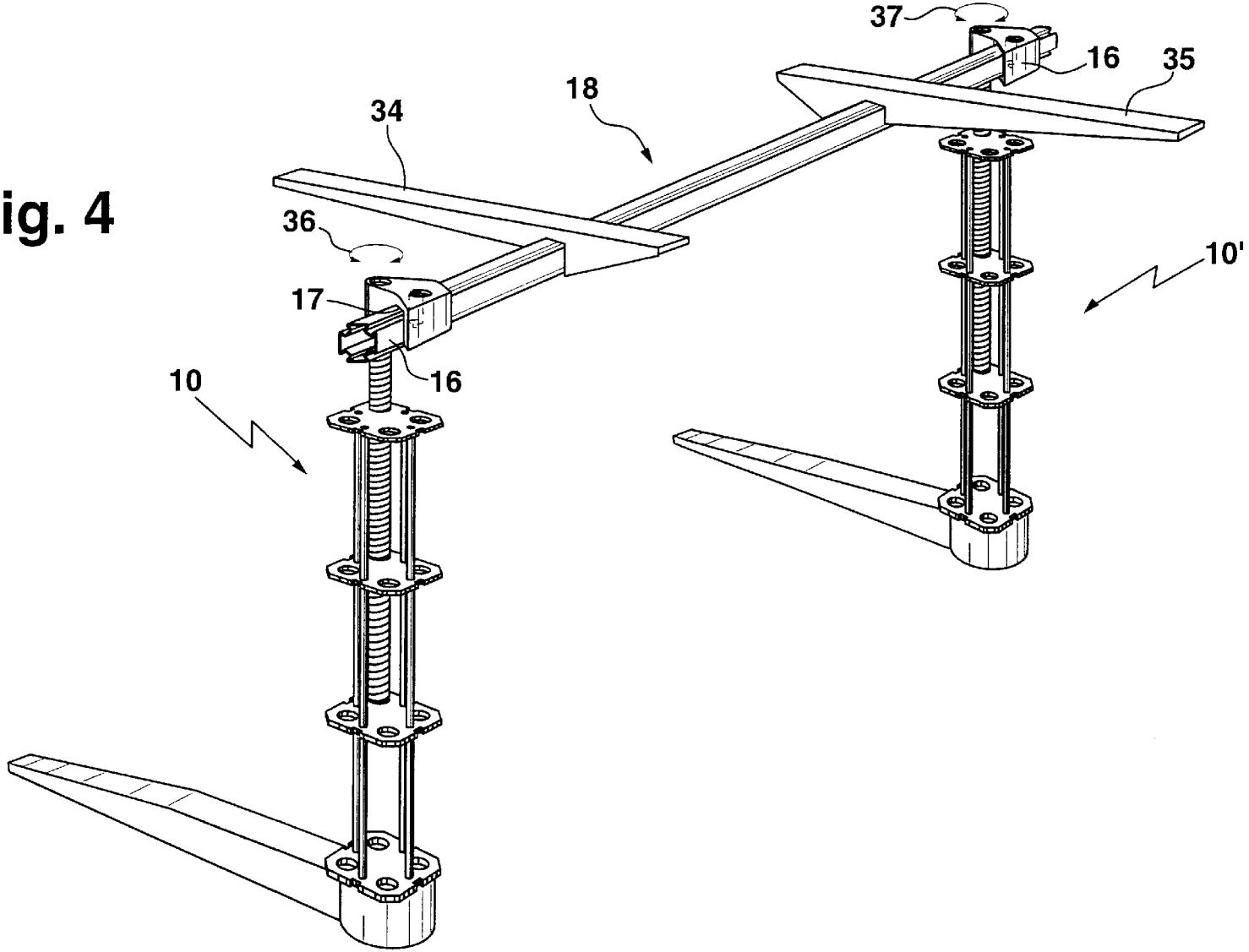
FIG. 4 shows an example of an application for two table support structures in accordance with the invention which are connected to each other via a support.

FIG. 4 shows a table support structure 10 which is connected to an additional table support structure 10' via a support 18. The support 18 is held without displacement in the adapters 16 of the table support structure 10, 10'. Extension arms 34, 35 are disposed on support 18 onto which e. g. a table plate can be attached. The table support structure 10' can be rotated about the table support structure 10 in the direction of arrow 36. The table support structure 10 can be rotated about the table support structure 10' in the direction of arrow 37 when the table support structure 10' is stationary.

Clearly, the column plates can be disposed at differing separations from another. It is also clear that the column plates can have a differing number of through holes. Bars with associated adapters can be simultaneously disposed in plates having differing heights.

A table support structure 10 comprises a column 11 and a foot 12. A bar 13 is disposed in the column 11 and can be rotated within the column in the direction of arrow 14 and displaced within the column in the direction of arrow 15. The column 11 comprises plates 19, 20, 21 and 22 which are held together by means of support rods 24. A plurality of bars 13 can be simultaneously introduced into the column 11 to hold, via an adapter 16, a support 18 to which various objects such as additional supports, plates, extension arms and the like can be attached.

I claim:

1. A table structure comprising:

a column having a plurality of mutually separated stacked plates, each of said plates having a through hole aligned with through holes of other plates, said column also having a support rod holding said plates together in a vertical direction;

a bar vertically directed within said column, said bar passing through said through holes in said plates, said bar rotatable and displaceable with respect to said plates;

an adapter mounted to a free end of said bar projecting above said column for mutual rotation with said bar, said adapter having a receptacle; a transverse support having a free end accepted in said receptacle for attachment of said transverse support to said adapter; and a foot mounted to a bottom of said column.

2. The structure of claim 1, wherein each plate has a plurality of at least two holes for accepting a plurality of at least two bars.

3. The structure of claim 2, wherein each plate has four through holes for passage of four bars.

4. The structure of claim 1, characterized in that a separation between said through hole and said support rod is larger than a largest outer dimension of said adapter.

5. The structure of claim 1, characterized in that a vertical separation between two adjacent plates is larger than a maximum height of said adapter.

6. The structure of claim 1, wherein said plates have grooves around an outer periphery thereof.

7. The structure of claim 1, wherein said adapter comprises a bolt guided for eccentric rotation in said receptacle.

8. The structure of claim 1, wherein the transverse support has a plurality of dovetail-shaped protrusions distributed around an outer periphery thereof.

9. The structure of claim 8, further comprising extension arms disposed on said transverse support and projection in a direction transverse to an extension of said transverse support.

10. The structure of claim 1, wherein said bar has ringed grooves disposed in an outer periphery thereof at axial separations from another.

11. The structure of claim 1, wherein at least one of said plates has a catch pivotably mounted to said at least one plate which pivots to slightly project into said through hole in a radial direction.

* * * * *